US006042022A

United States Patent [19]

Rogozinski et al.

[11] Patent Number: 6,042,022

[45] Date of Patent: Mar. 28, 2000

[54] SNOW GLOBE SPRAY BOTTLE

[75] Inventors: Nancy F. Rogozinski, New York, N.Y.; Larry Couey, Easton, Conn.

[73] Assignee: Gryphon Development, New York, N.Y.

[21] Appl. No.: 09/216,141

[22] Filed: Dec. 18, 1998

[51] Int. Cl.[7] ..... B05B 17/00

[52] U.S. Cl. ..... 239/211; 239/289; 40/410; 40/406; 446/475; 222/192

[58] Field of Search ..... 239/211, 333, 239/289, 302; 222/78, 192; 40/406, 410; 446/153, 167, 475

[56] References Cited

U.S. PATENT DOCUMENTS

D. 260,731 9/1981 Sarac .
D. 270,039 8/1983 Lipscombe .
D. 291,179 8/1987 Frizon .
5,187,889 2/1993 Kraselsky et al. ..... 40/410 X
5,406,728 4/1995 Willitts, Jr. ..... 40/410 X
5,603,176 2/1997 Eddins et al. ..... 40/406 X
5,705,210 1/1998 Sillince et al. .

*Primary Examiner*—Lesley D. Morris
*Attorney, Agent, or Firm*—Colucci & Umans

[57] ABSTRACT

A spherical bottle has a pump spray atomizer connected at a neck opening and a thin plastic sheet with printing or a graphic inside the bottle. The bottle contains a liquid fragrance or body splash which can be atomized. Flakes or chips resembling falling snow are dispersed within the bottle. The chips are large enough so that they do not fit into the spray pump mechanism. A ceramic base receives the spray atomizer so that the bottle can stand on the base with the spray atomizer down when it is stored. When stored on the base, the bottle has the appearance of a snow globe and can be used decoratively.

16 Claims, 2 Drawing Sheets

SNOW GLOBE SPRAY BOTTLE

FIELD AND BACKGROUND OF THE INVENTION

The present invention relates generally to the field of spray bottles and atomizers and in particular to a new and useful spray bottle for a fragrance resembling a snow globe.

Display articles containing solid objects in a translucent material are known. Snow globes are commonly sold as souvenirs. These snow globes usually have a scene, or object, contained in a spherical or domed enclosure of clear glass or plastic mounted on a flat-bottomed base. The object is surrounded by water or other non-volatile clear liquid. It is also common to have a plurality of small white "flakes" of material in the enclosure, so that when the globe is shaken, the flakes are mixed in the liquid and give the appearance of snow falling on the scene in the enclosure. These snow globes are sealed shut and the liquid inside is not accessible once the product is in its finished form.

A clear bottle with a pump dispenser containing a transparent soap is sold by Colgate-Palmolive Company in its AQUARIUM series. The bottle has a clear plastic sheet insert with a graphic printed on it. The plastic sheet is about as wide as the bottle. The graphic can be viewed through the front side of the bottle. The plastic sheet floats freely, suspended in the viscous soap composition.

Other bottles having inserts or display features are disclosed, for example, by U.S. Pat. No. 5,705,210, which teaches a deformable insert for beverage bottles. The insert is too large to pass through the bottle's neck without being deformed. The insert expands to its original shape after being inserted into a bottle.

U.S. Pat. No. 5,603,176 discloses a jar containing a gel and an object movably suspended within the gel. The gel is a transparent liquid composed of a nontoxic inorganic clay colloidal dispersion in water. In one embodiment disclosed, the jar simulates a fishbowl, with a plastic fish suspended in the gel.

A decorative display enclosure with one flat viewing surface in the side is disclosed by U.S. Pat. No. 5,406,728. The enclosure may be made of glass or plastic and contains a figure and a liquid surrounding the figure. The liquid may contain glitter or particles resembling snow flakes. A picture or hologram is applied to the flat surface of the enclosure.

U.S. Pat. No. 5,187,889 teaches a display globe holding a flowable solid material and solid objects, such as sand and sea shells, which can be shaken to create new decorative scenes. The solid material and solid objects are inserted through a cap opening which is sealed closed to prevent the flowable solid from spilling out of the globe.

Patented designs for containers having objects suspended therein include that of U.S. Pat. No. Des. 260,731, which illustrates a test tube having a figure of a baby suspended in a clear liquid.

A spherical bottle having a threaded cap closure over the bottle neck is disclosed by U.S. Pat. No. Des. 270,039. The bottle has a shell covering the top portion of the bottle around the neck which resembles a covering of snow or frost.

U.S. Pat. No. Des. 291,179 shows a spherical bottle with a flattened bottom. The opening of the bottle is a depression formed in the flattened bottom of the sphere. A cap or stopper extends from the depression and forms a stand for the bottle.

None of the prior art bottles known combine the decorative appearance of a snow globe with a fragrance bottle.

SUMMARY OF THE INVENTION

It is an object of the present invention to provide a fragrance bottle having a decorative appearance while stored and a pump spray to dispense the contents of the bottle when used.

Accordingly, a spherical bottle having a pump spray atomizer connected at a neck opening has a thin plastic sheet with printing or a graphic inside the bottle. The bottle contains a liquid fragrance which can be atomized. The plastic sheet is shaped approximately the same and is about the same diameter as the spherical bottle, so that it extends between the sides of the bottle. The plastic sheet has a tab at the bottom edge for fitting around the interior base of the spray atomizer. The tab holds the plastic sheet in place within the liquid in the bottle and prevents the sheet from rotating or falling.

Small pieces, or chips, of shiny plastic can be placed in the spherical bottle, so that when the bottle is shaken, the chips disperse and scatter throughout the volume of the bottle within the liquid. The chips resemble falling snow, as in a known snow globe. The chips are large enough so that they do not fit into the spray pump mechanism.

A ceramic base receives the spray atomizer so that the bottle can stand on the base with the spray atomizer down when it is stored. When stored on the base, the bottle has the appearance of a snow globe and can be used decoratively.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
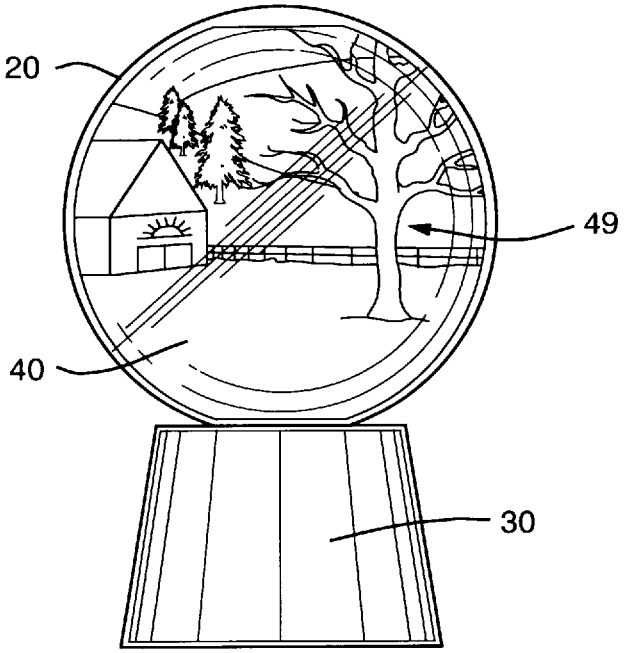
FIG. 1 is a front elevational view of a spray bottle of the invention.

Referring now to the drawings, in which like reference numerals are used to refer to the same or similar elements, FIG. 1 shows a spherical bottle 20 supported on stand or base 30. A flexible sheet 40 is suspended inside the bottle 20. The flexible sheet 40 bears a printed graphic 49 and is preferably opaque, so that the same or different graphics can be printed on both sides of the sheet 40. When the snow globe bottle 20 is mounted on the stand 30, the graphic 49 is oriented upright and the bottle 20, stand 30 and sheet 40 combine to resemble a traditional ornamental snow globe.

Figure 2:
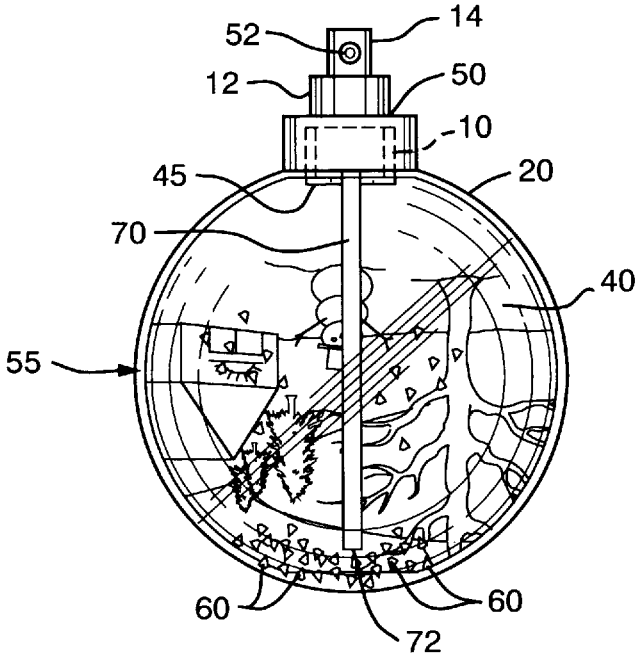
FIG. 2 is a front elevation view of the spray bottle removed from the base for use.

FIG. 2 shows the bottle 20 in greater detail. A pump spray dispenser 50 is connected to a top opening 10 of the unpressurized bottle 20 by known means, such as a threaded connector. The pump spray dispenser 50 which has a base 12 and an actuator 14 that can be pushed down into the base, withdraws liquid 55 from within bottle 20 through a dip tube or straw 70 at dip tube opening 72. The pump spray dispenser atomizes liquid 55 into a spray at outlet 52 in actuator 14. The liquid 55 is preferably a non-viscous transparent substance which is easily atomized. The liquid 55 may be scented, such as with a fragrance for use as a body splash or other perfume. The liquid 55 may also be tinted or colored, provided it is still transparent so that the graphic 49 is visible. Other useful liquids may be used in bottle 20, however.

Inside bottle 20, a plurality of small flakes 60 are dispersed in the liquid 55. When the bottle 20 is agitated, the flakes 60 mix and widely disperse in the liquid 55 throughout the bottle 20. The flakes 60 provide a snow effect to the bottle 20 when it is on the stand 30. Flakes 60 must be sized large enough so that they do not fit through dip tube opening 72. The flakes 60 should be light colored or have a reflective surface to simulate snow. A preferable material for the flakes 60 is PVC (polyvinyl chloride). The sheet 40 may also be made of PVC or PET (polyethylene terephthalate). Preferably, sheet 40 is 4 mil PET with UV adhesive and 1 mil polypropylene over lamination.

Figure 3:
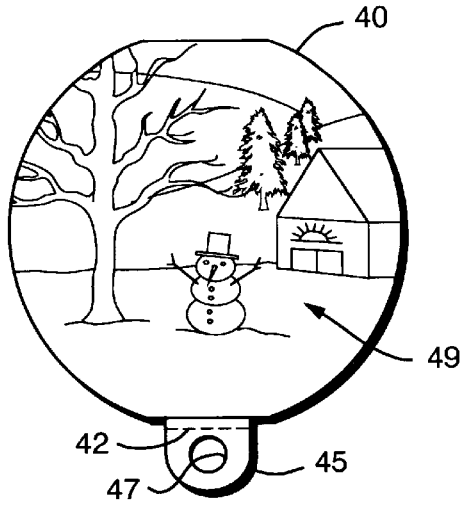
FIG. 3 is an enlarged front elevational view of an insert sheet used with the invention.

As shown in FIG. 3, the flexible sheet 40 has a tab 45 with a tab hole 47. The tab 45 is connected to the flexible sheet 40 by a perforated crease 42. The tab 45 can be bent about 90° to extend to the side of the sheet 40 at crease 42.

As seen in FIG. 2, the dip tube 70 may be inserted through the tab hole 47 when the sheet 40 is in the bottle 20 to hold the sheet 40 in place. Due to the shape and size of sheet 40, it can pivot around dip tube 70, but does not slide down the sides of bottle 20 or float upwardly. The sheet 40 thus always stays upright in the bottle.

Figure 4:
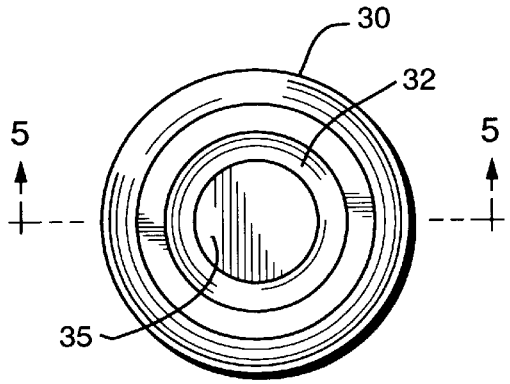
FIG. 4 is a top plan view of the base support for the bottle.
Figure 5:
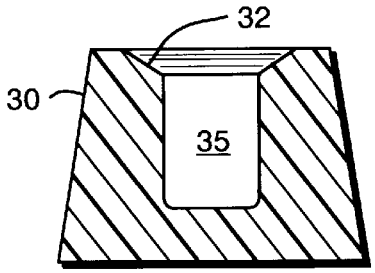
FIG. 5 is a sectional view of the base taken along line 5—5 of FIG. 4.

The base 30 is best seen in FIGS. 4 and 5. A space 35 for accepting the pump dispenser 50 is centrally located through the top of the base 30. A sloped shoulder 32 is provided around the edge of the space 35. The shoulder 32 is angled inwardly to mate with the surface of the bottle 20 around the pump dispenser 50. The shoulder 32 may be padded to help prevent scratches and breakage of the bottle 20. The sides of the base 30 are tapered outwardly from the top edge adjacent the shoulder 32 to provide additional stability with a wider bottom.

Base 30 may be molded from plastic or made from a different material such as ceramic, however, it must have a suitable weight and bottom width to prevent the bottle from tipping over when it is supported on the base 30. Further, base 30 may have a decorative design as well, or it may be plain.

The invention may also use a different shape for the bottle, such as a dome, that is, circular or oval, a cylinder or other shape. The base may also be eliminated if the bottle is shaped so that it may remain upright.

While a specific embodiment of the invention has been shown and described in detail to illustrate the application of the principles of the invention, it will be understood that the invention may be embodied otherwise without departing from such principles.

What is claimed is:

1. A dispensing container resembling a snow globe comprising:

a substantially spherical transparent bottle having a top opening and containing a transparent liquid;

a plurality of flakes dispersed within the liquid in the bottle;

spray means connected to the bottle at the top opening for manually dispensing the liquid in the bottle in a spray, the spray means sized to prevent any of the plurality of flakes from entering the spray means;

an insert sheet having a printed graphic held in the container by the spray means, the graphic being viewable within the bottle and liquid; and base means for holding the bottle with the top opening oriented downwardly so that the graphic is right side up and forms a complimentary scene with the flakes when the bottle is agitated.

2. A dispensing container according to claim 1, wherein the insert sheet is a flexible sheet having holding means for retaining the sheet in place within the bottle.

3. A dispensing container according to claim 2, wherein the holding means comprises a tab having a hole securable around the spray means.

4. A dispensing container according to claim 3, wherein the spray means comprises a spray pump dispenser connected to the top opening having atomizing means for atomizing liquid dispensed from an outlet of the dispenser and a dip tube supplying liquid to the atomizing means, the tab hole being secured around the dip tube.

5. A dispensing container according to claim 1, further comprising holding means for retaining the insert sheet in place within the bottle.

6. A dispensing container according to claim 1, wherein the transparent liquid is a body splash.

7. A dispensing container according to claim 1, wherein the transparent liquid is colored.

8. A dispensing container according to claim 1, wherein the transparent liquid contains a fragrance.

9. A dispensing container comprising:

a bottle having an opening and containing a transparent liquid;

a plurality of particles dispersed within the liquid in the bottle;

spray means connected to the bottle at the opening for dispensing the liquid from the bottle, the spray means being structured to avoid particles from entering the spray means;

an insert sheet held in the container by the spray means, the sheet being viewable within the bottle and liquid; and orientation means between the spray means and the sheet for maintaining the sheet in a viewable orientation in the bottle.

10. A dispensing container according to claim 9, wherein the orientation means comprises a tab having a hole securable around the spray means.

11. A dispensing container according to claim 10, wherein the spray means comprises a spray pump dispenser connected to the opening having atomizing means for atomizing liquid dispensed from an outlet of the dispenser and a dip tube supplying liquid to the atomizing means, the tab hole being secured around the dip tube.

12. A dispensing container according to claim 9, wherein the transparent liquid is a scented body splash.

13. A dispensing container according to claim 9, wherein the transparent liquid is colored.

14. A dispensing container according to claim 9, including a base with a recess for receiving at least part of the spray means for supporting the bottle on the base.

15. A dispensing container according to claim 14, wherein the bottle is sub-spherical and the base has a flat bottom.

16. A dispensing container according to claim 9, wherein the transparent liquid contains a fragrance.

* * * * *